US005942337A

United States Patent [19]

Rickerby et al.

[11] Patent Number: 5,942,337

[45] Date of Patent: Aug. 24, 1999

[54] THERMAL BARRIER COATING FOR A SUPERALLOY ARTICLE AND A METHOD OF APPLICATION THEREOF

[75] Inventors: David S Rickerby, Derby; Rodney G Wing, Nottingham, both of United Kingdom

[73] Assignees: Rolls-Royce, PLC, London; Chromalloy United Kingdom Limited, Eastwood Nottingham, both of United Kingdom

[21] Appl. No.: 08/869,951

[22] Filed: Jun. 5, 1997

[30] Foreign Application Priority Data

Jun. 19, 1996 [GB] United Kingdom ..... 9612811

[51] Int. Cl.[6] ..... C23C 10/02; C23C 10/60; B32B 15/04

[52] U.S. Cl. ..... 428/623; 428/629; 428/633; 428/670; 428/678; 148/518; 148/537

[58] Field of Search ..... 428/632, 633, 428/629, 610, 937, 935, 623, 670, 678, 941; 148/537, 518; 427/405

[56] References Cited

U.S. PATENT DOCUMENTS

| | | | |
|---|---|---|---|
| 3,961,910 | 6/1976 | Baladjanian et al. | 29/197 |
| 4,070,507 | 1/1978 | Stueber et al. | 427/252 |
| 4,477,538 | 10/1984 | Clarke | 428/670 |
| 4,962,005 | 10/1990 | Alperine et al. | 428/670 |
| 5,238,752 | 8/1993 | Duderstadt et al. | 428/623 |
| 5,427,866 | 6/1995 | Nagaraj et al. | 428/610 |
| 5,500,252 | 3/1996 | Meelu | 427/405 |
| 5,514,482 | 5/1996 | Strangman | 428/623 |
| 5,645,893 | 7/1997 | Rickerby et al. | 427/405 |
| 5,658,614 | 8/1997 | Basta et al. | 427/252 |
| 5,667,663 | 9/1997 | Rickerby et al. | 427/405 |
| 5,716,720 | 2/1998 | Murphy | 428/629 |
| 5,763,107 | 6/1998 | Rickerby et al. | 428/629 |
| 5,788,823 | 8/1998 | Warnes et al. | 427/405 |

FOREIGN PATENT DOCUMENTS

| | | |
|---|---|---|
| 0 178 420 A1 | 6/1996 | European Pat. Off. . |
| 0 718 419 A2 | 6/1996 | European Pat. Off. . |
| A-2 041 246 | 9/1980 | United Kingdom . |
| A1-0 654 542 | 5/1995 | United Kingdom . |
| A-2 285 632 | 7/1995 | United Kingdom . |
| WO 94/18359 A1 | 8/1994 | WIPO . |
| WO 95/23243 | 8/1995 | WIPO . |

*Primary Examiner*—John J. Zimmerman
*Attorney, Agent, or Firm*—Oliff & Berridge, PLC

[57] ABSTRACT

A multi-layer thermal barrier coating (42) for a superalloy article (40) comprises a platinum enriched superalloy layer (44), an MCrAlY bond coating (46) on the platinum enriched superalloy layer (44), a platinum enriched MCrAlY layer (48) on the MCrAlY bond coating (46), a platinum aluminide coating (50) on the platinum enriched MCrAlY layer (48), an oxide layer (54) on the platinum aluminide coating (50) and a ceramic thermal barrier coating (56) on the oxide layer (54). The platinum aluminide coating (50) and the platinum enriched MCrAlY layer (48) reduce movement of transition metals from the superalloy substrate (40) and the MCrAlY bond coating (46) to the oxide layer (54) so that the oxide layer is very pure alumina. The platinum enriched superalloy layer (44) reduces movement of aluminium from the MCrAlY bond coating (46) to the superalloy substrate (40) so that the oxide layer (54) remains pure alumina to improve long term adhesion of the ceramic thermal barrier coating (56), and additionally reduces movement of transition metals from the superalloy substrate (40) to the oxide layer (54).

28 Claims, 2 Drawing Sheets

THERMAL BARRIER COATING FOR A SUPERALLOY ARTICLE AND A METHOD OF APPLICATION THEREOF

BACKGROUND OF THE INVENTION

1. Field of the Invention

The present invention relates to a thermal barrier coating applied to the surface of a superalloy article, e.g. a gas turbine engine turbine blade, and to a method of applying the thermal barrier coating.

2. Description of Related Art

The constant demand for increased operating temperature in gas turbine engines was initially met by air cooling of the turbine blades and development of superalloys from which to manufacture the turbine blades and turbine vanes, both of which extended their service lives. Further temperature increases necessitated the development of ceramic coating materials with which to insulate the turbine blades and turbine vanes from the heat contained in the gases discharged from the combustion chambers, again the operating lives of the turbine blades and turbine vanes was extended. However, the amount of life extension was limited because the ceramic coatings suffered from inadequate adhesion to the superalloy substrate. One reason for this is the disparity of coefficients of thermal expansion between the superalloy substrate and the ceramic coating. Coating adhesion was improved by the development of various types of aluminium containing alloy bond coatings which were thermally sprayed or otherwise applied to the superalloy substrate before the application of the ceramic coating. Such bond coatings are typically of the so-called aluminide (diffusion) or "MCrAlY" types, where M signifies one or more of cobalt, iron and nickel.

Use of bond coatings has been successful in preventing extensive spallation of thermal barrier coatings during service, but localised spallation of the ceramic coating still occurs where the adhesion fails between the bond coating and the ceramic coating. This exposes the bond coating to the full heat of the combustion gases, leading to premature failure of the turbine blade or turbine vane.

SUMMARY OF THE INVENTION

The present invention seeks to provide a novel bond coating for a thermal barrier coating which is less prone to localised failure and more suitable for long term adhesion to a superalloy substrate.

The present invention seeks to provide a method of applying a thermal barrier coating to a superalloy substrate so as to achieve improved adhesion thereto.

Accordingly the present invention provides a multi-layer thermal barrier coating for a superalloy substrate, comprising a platinum-group metal enriched superalloy layer, an aluminium containing alloy bond coating on the platinum-group metal enriched superalloy layer, a platinum-group metal enriched aluminium containing alloy layer on the aluminium containing alloy bond coating, a coating of at least one aluminide of the platinum-group metals on the platinum-group metal enriched aluminium containing alloy layer, an oxide layer on the coating of at least one platinum-group metal aluminide and a ceramic thermal barrier coating on the oxide layer.

The present invention also provides a method of applying a multi-layer thermal barrier coating to a superalloy substrate comprises the steps of: applying a layer of platinum-group metal to the superalloy substrate, heat treating the superalloy article to diffuse the platinum-group metal into the superalloy substrate to create a platinum-group metal enriched superalloy layer at the surface of the superalloy substrate, applying an aluminium containing alloy bond coating to the platinum-group metal enriched superalloy layer, applying a layer of platinum-group metal to the aluminium containing alloy bond coating, heat treating the superalloy article to diffuse the platinum-group metal into the aluminium containing alloy bond coating to create a platinum-group metal enriched aluminium containing alloy layer and a coating of at least one aluminide of the platinum-group metals, forming a layer of oxide on the at least one aluminide of the platinum-group metals and applying a ceramic thermal barrier coating to the oxide layer.

An advantage over prior art coatings is that the coating of at least one aluminide of the platinum-group metals facilitates the creation of an oxide layer comprising at least 70% by volume of alumina, preferably at least 90% by volume of alumina, most preferably 95% by volume alumina. It is believed that the present invention enables the creation of an oxide layer comprising alumina without other spinels in amounts sufficient to substantially disrupt the alumina lattice structure. It is believed that the platinum-group metal enriched superalloy layer on the superalloy substrate reduces the movement of aluminium from the aluminium containing alloy bond coating to the superalloy substrate and also reduces the movement of damaging elements from the superalloy substrate to the oxide layer. It is believed that by reducing the movement of aluminium from the aluminium containing alloy to the superalloy substrate the aluminium level in the aluminium containing alloy bond coating is retained at a relatively high level to ensure that alumina is continuously formed underneath the ceramic thermal barrier coating for longer periods of time. It is believed that the coating of at least one aluminide of the platinum-group metals blocks the movement of damaging elements from the superalloy substrate and aluminium containing alloy bond coating to the oxide layer.

For the purposes of the present specification, a spinel is defined as an oxide having a general formula $M_2O_3$, where M signifies a transition metal.

To produce a platinum enriched superalloy layer at the surface of the superalloy substrate the thickness of the layer of platinum as applied before diffusion is preferably at least 5 microns, and most preferably is 8 microns.

The diffusion heat treatment is preferably carried out for about one hour at a temperature in the range 800 to 1200° C., preferably 1000 to 1100° C., depending upon the composition of the superalloy substrate.

The aluminium containing alloy bond coating may be a nickel or cobalt aluminide, but an MCrAlY alloy is preferred, where M is at least one of Ni, Co and Fe. The bond coating's aluminium content will depend upon the type of bond coating alloy chosen for use with the invention, being a minimum of about 5% by weight for an MCrAlY alloy bond coating and a maximum of about 40% by weight for an aluminide bond coating.

Preferably in the finished article, the outer layer of the bond coating is enriched with platinum and in this case the aluminide surface coating predominantly comprises platinum aluminide.

We believe that such a platinum aluminide surface coating will contain at least 25 wt % platinum, preferably at least 40 wt % and optimally at least 50 wt % platinum, with aluminium levels of at least 8 wt %, preferably at least 10 wt %.

To produce a platinum enriched aluminium containing alloy layer with an aluminide surface coating predominantly comprising platinum aluminide, the thickness of the layer of platinum as applied before diffusion is preferably at least 5 microns, and most preferably is 8 microns.

The diffusion heat treatment is preferably carried out for about one hour at a temperature in the range 1000 to 1200° C., preferably 1100 to 1200° C., depending upon the composition of the superalloy substrate.

After cleaning off any diffusion residues from the surface of the platinised aluminium alloy bond coating, the article receives its thin adherent layer of oxide and its ceramic thermal barrier coating.

Preferably the thickness of the oxide layer as produced by the above process is less than one micron. The thin adherent layer of oxide is preferably created by heating the platinum-group metal aluminide coating in an oxygen containing atmosphere.

Conveniently for the creation of the thin adherent oxide layer, we prefer to use electron beam physical vapour deposition (EBPVD) to apply the ceramic thermal barrier coating. In the preferred EBPVD process, the article is preheated to a temperature in the range 900 to 1150° C. in a vacuum, say at a pressure of about $10^{-5}$ Torr. A preferred preheat temperature is about 1000° C.

The EBPVD ceramic thermal barrier coating process, using yttria stabilised zirconia or other oxide ceramic, involves evaporation of the ceramic by the electron beam and consequent liberation of oxygen by dissociation of the ceramic. We also prefer to add oxygen to the coating chamber deliberately at this stage to encourage stoichiometric reformation of the ceramic on the article being coated. Hence, in our preferred process, oxygen is inevitably present in the atmosphere of the coating chamber during coating by EBPVD and reacts with the preferred platinum aluminide surface coating, forming the thin adherent oxide layer mentioned above.

BRIEF DESCRIPTION OF THE DRAWINGS

The present invention will be more fully described by way of example with reference to the accompanying drawings, in which.

DETAILED DESCRIPTION OF PREFERRED EMBODIMENTS

Figure 1:
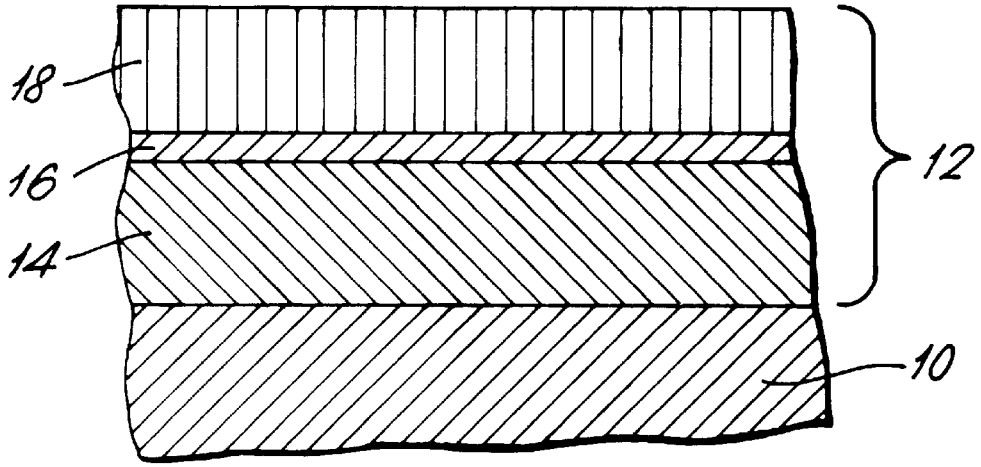
Fig.1. PRIOR ART
FIG. 1 is a cross-sectional diagrammatic view through a metallic article having a prior art thermal barrier coating applied thereto.

Referring to FIG. 1, illustrating the state of the art, there is shown part of a superalloy article 10 provided with a multi-layer thermal barrier coating indicated generally by numeral 12. It is shown in the as manufactured condition. The thermal barrier coating 12 comprises a MCrAlY alloy bond coating 14, a thin oxide layer 16 and a columnar grain ceramic thermal barrier coating 18. The MCrAlY alloy bond coating 14 is applied by plasma spraying and is diffusion heat treated. The columnar grain ceramic thermal barrier coating 18 comprises yttria stabilised zirconia or other suitable ceramic applied by electron beam physical vapour deposition. The thin oxide layer 16 comprises a mixture of alumina, chromia and other spinels.

Figure 2:
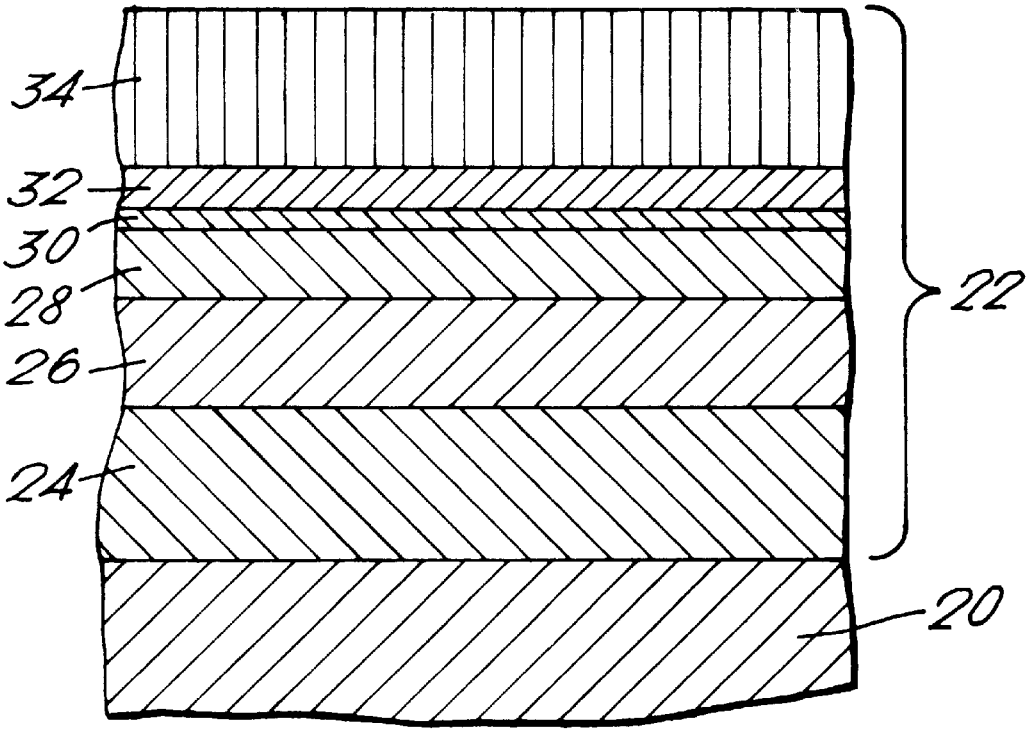
Fig.2. PRIOR ART
FIG. 2 is a cross-sectional diagrammatic view through a metallic article having a prior art thermal barrier coating applied thereto.

Referring to FIG. 2, illustrating the state of the art as described in our co-pending European patent application 95308925.7 filed Dec. 8, 1995, there is shown part of a superalloy article 20 provided with a multi-layer thermal barrier coating indicated generally by numeral 22. It is shown in the as manufactured condition. The thermal barrier coating 22 comprises a MCrAlY alloy bond coating 24, a platinum enriched MCrAlY alloy layer 26 on the MCrAlY alloy bond coating 24, a platinum aluminide coating 28 on the platinum enriched MCrAlY alloy layer 26, a platinum enriched gamma phase layer 30 on the platinum aluminide coating 28, a thin oxide layer 32 on the platinum enriched gamma phase 30 and a columnar grain ceramic thermal barrier coating 34.

The MCrAlY alloy bond coating 24 is applied by plasma spraying and is diffusion heat treated. The columnar grain ceramic thermal barrier coating 34 comprises yttria stabilised zirconia or other suitable ceramic applied by electron beam physical vapour deposition. The thin oxide layer 32 comprises wholly or almost wholly alumina, with much smaller or negligible amounts of the other spinels. The thickness of alumina layer 32 is less than one micron.

The platinum is applied to a substantially uniform thickness onto the MCrAlY bond coating by electroplating or other suitable method, the thickness being at least 5 microns, and preferably about 8 microns. Thereafter a diffusion heat treatment step is effected so as to cause the platinum layer to diffuse into the MCrAlY alloy bond coating. This provides the platinum enriched MCrAlY alloy layer and the platinum aluminide coating. Diffusion is achieved by heating the article to a temperature in the range of 1000° C. to 1200° C. and holding at that temperature for a suitable period of time, in particular a temperature of 1150° C. for a period of one hour is a suitable diffusion heat treatment cycle.

After heat treatment the surface is grit blasted with dry alumina powder to remove any diffusion residues. The ceramic thermal barrier coating is then applied by EBPVD, to produce the thin oxide layer on the platinum aluminide coating with a platinum enriched gamma phase layer therebetween.

The thermal barrier coating 12 described with reference to FIG. 1 and the thermal barrier coating 22 described with reference to FIG. 2 have been tested. It has been found that the thermal barrier coating 12 has a critical load, beyond which the ceramic would break away from the bond coating, of about 55 Newtons in the as manufactured condition and about 5 Newtons after ageing at 1150° C. for 100 hours. It has also been found that the thermal barrier coating 22 has a critical load, beyond which the ceramic would break away from the bond coating, of about 100 Newtons in the as manufactured condition and about 50 Newtons after ageing at 1150° C. for 100 hours, see our co-pending European patent application no. 95308925.7 filed Dec. 8, 1995.

It can be seen that the thermal barrier coating 22 shown in FIG. 2 gives a significant improvement in long term adhesion relative to the thermal barrier coating shown in FIG. 1.

The thermal barrier coating 22 in FIG. 2 has a continuous platinum aluminide coating 28 which it is believed blocks the movement of transition metal elements, for example titanium, tantalum and hafnium, from the MCrAlY bond coating 24 and the superalloy substrate 20 to the oxide layer 32 and ensures that the oxide layer formed is very pure alumina.

Unfortunately it has been found that long term adhesion of the thermal barrier coating 22 is then dictated by the loss of aluminium from the MCrAlY alloy bond coating 24 and the platinum enriched MCrAlY alloy layer 26 to the superalloy substrate 20. It is believed that with continued operation of the thermal barrier coating 22 at high temperatures for long periods of time the aluminium in the MCrAlY diffuses into the superalloy substrate 20. The alumina in the oxide layer 32 is continuously used up and replaced by alumina formed by oxidation of aluminium diffusing from the platinum aluminide coating 28, the platinum enriched MCrAlY layer and the MCrAlY alloy bond coating 26 to the interface with the ceramic thermal barrier coating 34. Thus it is believed that the loss of aluminium from the MCrAlY alloy bond coating 26 and platinum enriched MCrAlY alloy layer 28 to the superalloy substrate 20 will reduce the level of aluminium available for forming alumina in the oxide layer 32 and reduce the level required to sustain its formation to replace alumina used up in service.

Figure 3:
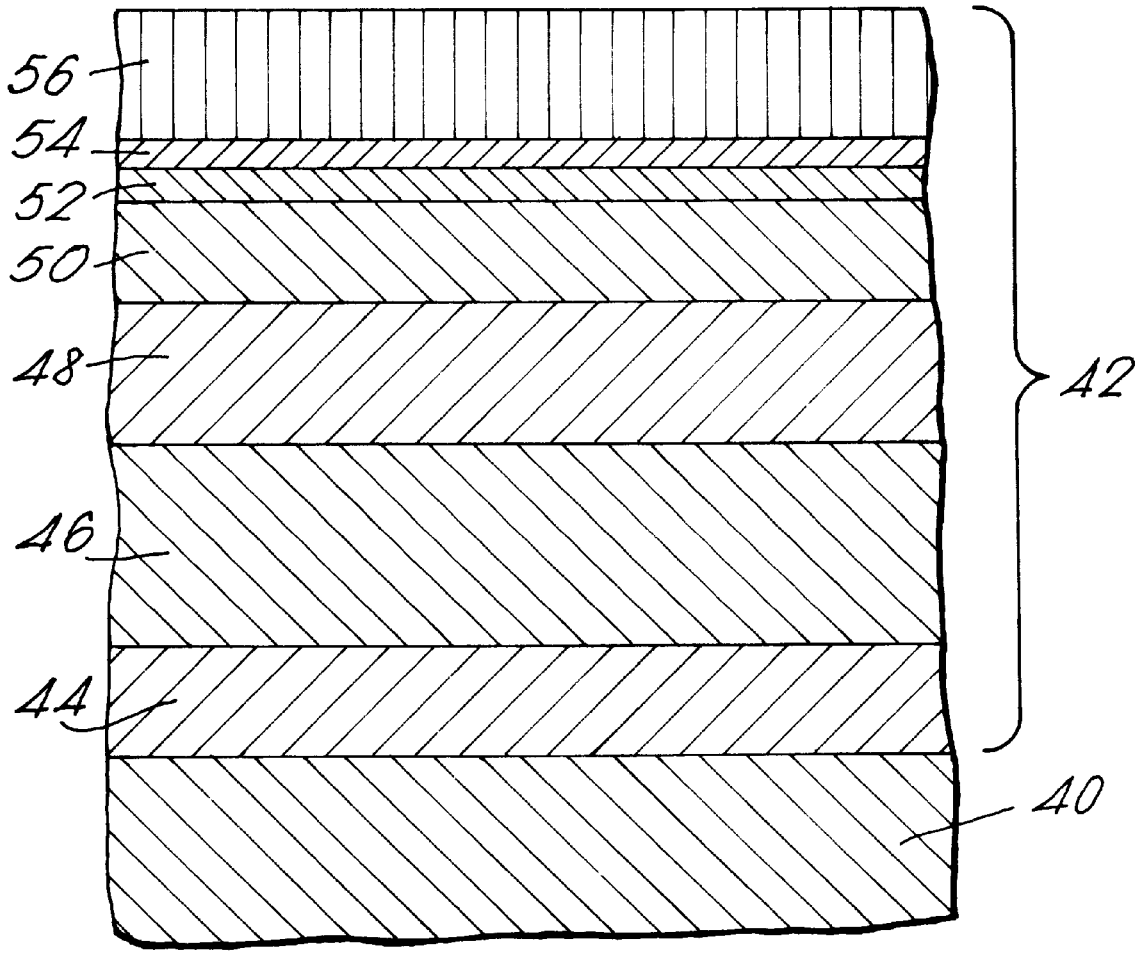
FIG. 3 is a cross-sectional diagrammatic view through a metallic article having a thermal barrier coating according to the present invention.

Referring to FIG. 3, illustrating the present invention there is shown part of a superalloy article 40 provided with a multi-layer thermal barrier coating indicated generally by numeral 42. It is shown in the as manufactured condition. The thermal barrier coating 42 comprises a platinum enriched layer 44 which comprises platinum enriched gamma and platinum enriched gamma prime phases at the surface of the superalloy substrate, a MCrAlY alloy bond coating 46 on the layer 44, a platinum enriched MCrAlY alloy layer 48 on the MCrAlY alloy bond coating 46, a platinum aluminide coating 50 on the platinum enriched MCrAlY alloy layer 48, a platinum enriched gamma phase layer 52 on the platinum aluminide coating 50, a thin oxide layer 54 on the platinum enriched gamma phase 52 and a columnar grain ceramic thermal barrier coating 56. The platinum aluminide coating 50 is a special form of platinum aluminide and has a composition for example of 53 wt % Pt, 19.5 wt % Ni, 12 wt % Al, 8.7 wt % Co, 4.9 wt % Cr, 0.9 wt % Zr, 0.6 wt % Ta, 0.1 wt % O and 0.04 wt % Ti as is described more fully in our co-pending European patent application no. 95308925.7.

The platinum is applied to a substantially uniform thickness onto the superalloy substrate by electroplating or other suitable method, the thickness being at least 5 microns, and preferably about 8 microns. Thereafter a diffusion heat treatment step is effected so as to cause the platinum layer to diffuse into the superalloy substrate. This provides the platinum enriched gamma and platinum enriched gamma prime layer on the superalloy substrate. Diffusion is achieved by heating the article to a temperature in the range of 800° C. to 1200° C. and holding at that temperature for a suitable period of time, in particular a temperature of 1000° C. for a period of one hour is a suitable diffusion heat treatment cycle, because of further heat treatment cycles which further diffuse the platinum enriched gamma and platinum enriched gamma prime layer.

The MCrAlY alloy bond coating 46 is applied by plasma spraying and is diffusion heat treated. The columnar grain ceramic thermal barrier coating 56 comprises yttria stabilised zirconia or other suitable ceramic applied by electron beam physical vapour deposition. The thin oxide layer 54 comprises wholly or almost wholly alumina, with much smaller or negligible amounts of the other spinels. The thickness of alumina layer 54 is less than one micron.

The platinum is applied to a substantially uniform thickness onto the MCrAlY bond coating by electroplating or other suitable method, the thickness being at least 5 microns, and preferably about 8 microns. Thereafter a diffusion heat treatment step is effected so as to cause the platinum layer to diffuse into the MCrAlY alloy bond coating. This provides the platinum enriched MCrAlY alloy layer and the platinum aluminide coating. Diffusion is achieved by heating the article to a temperature in the range of 1000° C. to 1200° C. and holding at that temperature for a suitable period of time, preferably by heating the article to a temperature in the range of 1100° C. to 1200° C., in particular a temperature of 1150° C. for a period of one hour is a suitable diffusion heat treatment cycle.

After heat treatment the surface is grit blasted with dry alumina powder to remove any diffusion residues. The ceramic thermal barrier coating is then applied by EBPVD, to produce the thin oxide layer on the platinum aluminide coating with a platinum enriched gamma layer therebetween.

The platinum enriched layer 44 comprising platinum enriched gamma and platinum enriched gamma prime phases produces a layer which reduces the movement of the aluminium from the MCrAlY alloy bond coating 46 and platinum enriched MCrAlY alloy layer 48 to the superalloy substrate, to maintain the aluminium levels in the MCrAlY alloy bond coating 46 and platinum enriched MCrAlY alloy layer 48 for longer time periods to further improve the long term adhesion of the thermal barrier coating. An additional advantage of the platinum enriched layer 44 is that it reduces the movement of transition metal elements from the superalloy substrate to the oxide layer 54 to provide additional protection from harmful transition metal elements, for example titanium, tantalum and hafnium, for the oxide layer 54 to maintain a highly pure alumina oxide layer 54.

The MCrAlY is preferably applied by vacuum plasma spraying although other suitable methods such as physical vapour deposition may be used. If vacuum plasma spraying is used the MCrAlY may be polished to improve the adhesion of the ceramic thermal barrier coating.

The platinum may also be applied by sputtering, pack diffusion, out of pack diffusion, chemical vapour deposition or physical vapour deposition. Other platinum-group metals, for example palladium, rhodium etc may be used instead of platinum, but platinum is preferred.

It may be possible to deposit the ceramic thermal barrier coating by plasma spraying, vacuum plasma spraying, chemical vapour deposition, combustion chemical vapour deposition or preferably physical vapour deposition. The physical vapour deposition processes include sputtering, but electron beam physical vapour deposition is preferred.

Other aluminium containing alloy bond coats other than MCrAlY may be used for example cobalt aluminide or nickel aluminide.

The thermal barrier coating may be applied to the whole of the surface of an article, or to predetermined areas of the surface of an article, to provide thermal protection to the article. For example the whole of the surface of the aerofoil of a gas turbine blade may be coated with a thermal barrier coating, or alternatively only the leading edge of the aerofoil of a gas turbine engine blade may be coated.

We claim:

1. A multi-layer thermal barrier coating for a superalloy substrate, comprising a platinum-group metal enriched superalloy layer, an aluminium containing alloy bond coating on the platinum-group metal enriched superalloy layer, a platinum-group metal enriched aluminium containing alloy layer on the aluminium containing alloy bond coating, a coating of at least one aluminide of the platinum-group metals on the platinum-group metal enriched aluminium containing alloy layer, an oxide layer on the coating of at least one platinum-group metal aluminide and a ceramic thermal barrier coating on the oxide layer.

2. A thermal barrier coating as claimed in claim 1 wherein the aluminium content of the aluminium containing alloy bond coating is in the range 5% to 40% by weight.

3. A thermal barrier coating as claimed in claim 1 wherein the aluminium containing alloy bond coating comprises a nickel or cobalt aluminide.

4. A thermal barrier coating as claimed in claim 1 wherein the aluminium containing alloy bond coating comprises a MCrAlY alloy, where M is at least one of Ni, Co and Fe.

5. A thermal barrier coating as claimed in claim 1, wherein the platinum-group metal enriched aluminium containing alloy layer is enriched with platinum and the coating of at least one aluminide of the platinum-group metals predominantly comprises platinum aluminide.

6. A thermal barrier coating as claimed in claim 1 wherein the platinum-group metal enriched aluminium containing superalloy layer is enriched in platinum.

7. A thermal barrier coating as claimed in claim 1 wherein the oxide layer comprises at least 90 vol % of alumina.

8. A thermal barrier coating as claimed in claim 1 wherein the ceramic thermal barrier coating comprises yttria stabilised zirconia.

9. A thermal barrier coating as claimed in claim 1 wherein the ceramic thermal barrier coating has a columnar structure.

10. A thermal barrier coating as claimed in claim 1 wherein the superalloy substrate comprises a nickel based superalloy or a cobalt based superalloy.

11. A thermal barrier coating as claimed in claim 1 wherein a platinum-group metal enriched gamma phase layer is between the coating of at least one aluminide of the platinum-group metals and the oxide layer.

12. A method of applying a multi-layer thermal barrier coating to a superalloy substrate comprising the steps of:

applying a layer of platinum-group metal to the superalloy substrate, heat treating the superalloy substrate to diffuse the platinum-group metal into the superalloy substrate to create a platinum-group metal enriched superalloy layer at the surface of the superalloy substrate, applying an aluminium containing alloy bond coating to the platinum-group metal enriched superalloy layer, applying a layer of platinum-group metal to the aluminium containing alloy bond coating, heat treating the superalloy substrate to diffuse the platinum-group metal into the aluminium containing alloy bond coating to create a platinum-group metal enriched aluminium containing alloy layer and a coating of at least one aluminide of the platinum-group metals, forming a layer of oxide on the coating of at least one aluminide of the platinum-group metals and applying a ceramic thermal barrier coating to the oxide layer.

13. A method as claimed in claim 12 wherein the aluminium containing alloy bond coating comprises a nickel or cobalt aluminide.

14. A method as claimed in claim 12 wherein the aluminium containing alloy bond coating comprises an MCrAlY alloy, where M is at least one of Ni, Co and Fe.

15. A method as claimed in claim 12 wherein the layer of platinum-group metal is applied to the superalloy substrate by an electroplating process.

16. A method as claimed in claim 13 wherein the layer of platinum-group metal is applied to the superalloy substrate by an electroplating process.

17. A method as claimed in claim 12 wherein the thickness of the layer of platinum-group metal applied to the superalloy substrate before diffusion is at least 5 microns.

18. A method as claimed in claim 12 wherein the thickness of the layer of platinum-group metal applied to the aluminium containing alloy bond coating before diffusion is at least 5 microns.

19. A method as claimed in claim 17 wherein the thickness of the platinum-group metal is 8 microns.

20. A method as claimed in claim 12 wherein the platinum-group metal is platinum.

21. A method as claimed in claim 12 wherein the heat treating of the superalloy substrate to diffuse the platinum-group metal into the superalloy substrate to create a platinum-group metal enriched superalloy layer at the surface of the superalloy substrate is carried out for about one hour at a temperature in the range 800 to 1200° C., dependent upon the solution treatment temperature appropriate for the superalloy substrate.

22. A method as claimed in claim 12 wherein the heat treating the superalloy substrate to diffuse the platinum-group metal into the aluminium containing alloy bond coating to create a platinum-group metal enriched aluminium containing alloy layer and a coating of at least one aluminide of the platinum-group metals is carried out for about one hour at a temperature in the range 1000 to 1200° C., dependent upon the solution treatment temperature appropriate for the superalloy substrate.

23. A method as claimed in claim 21 wherein the diffusion heat treatment is carried out at a temperature in the range 1000° C. to 1100° C.

24. A method as claimed in claim 22 wherein the diffusion heat treatment is carried out at a temperature in the range 1100° C. to 1200° C.

25. A method as claimed in claim 14 wherein the MCrAlY alloy coating is applied by vacuum plasma spraying, the MCrAlY alloy coating is subsequently polished and peened.

26. A method as claimed in claims 12 wherein the ceramic thermal barrier coating is applied by electron beam physical vapour deposition.

27. A thermal barrier coating as claimed in claim 1, wherein the platinum-group metal enriched superalloy layer comprises a platinum enriched gamma phase and a platinum enriched gamma prime phase.

28. A method as claimed in claim 12, wherein the platinum-group metal enriched superalloy layer comprises a platinum enriched gamma phase and a platinum enriched gamma prime phase.

* * * * *